US007516640B2

(12) United States Patent
Golovashchenko et al.

(10) Patent No.: US 7,516,640 B2
(45) Date of Patent: Apr. 14, 2009

(54) METHOD AND APPARATUS FOR FORMING A BLANK AS A PORTION OF THE BLANK RECEIVES PULSES OF DIRECT CURRENT

(75) Inventors: Sergey Fedorovich Golovashchenko, Beverly Hills, MI (US); Albert Krause, Plymouth, MI (US); John T. Roth, Erie, PA (US)

(73) Assignees: Penn State Research Foundation, University Park, PA (US); Ford Global Technologies, LLC, Dearborn, MI (US)

( * ) Notice: Subject to any disclaimer, the term of this patent is extended or adjusted under 35 U.S.C. 154(b) by 102 days.

(21) Appl. No.: 11/737,453

(22) Filed: Apr. 19, 2007

(65) Prior Publication Data

US 2008/0257007 A1 Oct. 23, 2008

(51) Int. Cl.
*B21D 37/16* (2006.01)

(52) U.S. Cl. ..... 72/342.96; 72/342.94

(58) Field of Classification Search ..... 72/342.1, 72/342.2, 342.5, 342.6, 342.8, 342.92, 342.94, 72/342.96; 219/108, 149

See application file for complete search history.

(56) References Cited

U.S. PATENT DOCUMENTS

| | | | | |
|---|---|---|---|---|
| 438,409 | A | 10/1890 | Dewey | |
| 1,112,779 | A | 10/1914 | Forsyth | |
| 1,251,578 | A | 1/1918 | Riecken | |
| 2,443,336 | A | 6/1948 | Waldie | |
| 3,933,020 | A | 1/1976 | Orr et al. | |
| 4,011,429 | A | 3/1977 | Morris et al. | |
| 4,170,887 | A | 10/1979 | Baranov | |
| 4,532,793 | A | 8/1985 | Bezold | |
| 5,515,705 | A * | 5/1996 | Weldon et al. | 72/19.1 |
| 6,463,779 | B1 | 10/2002 | Terziakin | |
| 6,550,302 | B1 * | 4/2003 | Ghosh | 72/342.8 |
| 7,028,522 | B2 * | 4/2006 | Kim et al. | 72/202 |
| 7,117,707 | B2 * | 10/2006 | Adams et al. | 72/342.5 |
| 7,302,821 | B1 * | 12/2007 | Dariavach et al. | 72/342.96 |

OTHER PUBLICATIONS

O.A. Troitskiy, Electromechanical Effect in Matals, Letters to the Journal of Experimental and Theoretical Physics, vol. 10, pp. 18-22, Jul. 5, 1969.

(Continued)

*Primary Examiner*—Edward Tolan
(74) *Attorney, Agent, or Firm*—Raymond L. Coppiellie; Brooks Kushman P.C.

(57) ABSTRACT

A method is provided for forming a sheet metal blank or tubular blank in a metal forming tool, such as a sheet metal press or a media forming tool. The sheet metal press has an upper die and a lower die that are moved by a press to form the metal blank. The forming tool has a plurality of electrodes that are connected in an electrical circuit to a source of direct current. The electrodes provide pulses of the electric current to at least a portion of the blank. The method comprises loading the blank into the forming tool and closing the upper die and the lower die. The electrical circuit is completed between multiple electrodes through one or more portions of the blank. Electrical current is pulsed intermittently through the blank in a plurality of pulses.

20 Claims, 6 Drawing Sheets

OTHER PUBLICATIONS

O.A. Troitskiy, Ultrasound Upsetting—Ultrasound Electroplastic Extrusion, Upsetting and Drawing of Difficult to Form Metals, http://www.expo.ras.ru/base/prod_data.asp?prod_id=1528.

Yu. V. Baranov, O.A. Troitskiy, Plastic Rolling—Electroplastic Rolling of Metallic Materials, http://www.expo.ras.ru/base/prod_data.asp?prod_id=1526.

Hans Conrad, Thermally Activated Plastic Flow of Metals and Ceramics with an Electric Field or Current, Materials Science & Engineering, A322 (2002) pp. 100-107.

Hans Conrad, Effects of Electric Current on Solid State Phase Transformations in Metals, Materials Science & Engineering, A287 (2000) pp. 227-237.

Hans Conrad, Electroplasticity in Metals and Ceramics, Materials Science & Engineering, A287, (2000) pp. 276-287.

I. Charit, Z.Y. Ma, and R.S. Mishra, High Strain Rate Superplasticity in Aluminum Alloys Via Friction Stir Processing, Advances in Superplasticity and Superplastic Forming, Edited by E.M. Taleff, P.A. Friedman, P.E. Krajewski, R.S. Mishra and J.G. Schroth, The Materials, Metals & Materials Society, 2004, pp. 201-209.

J.Unger, M. Stiemer, L. Walden, F. Bach, H. Blum, B. Svendsen, On the Effect of Current Pluses on the Material Behavior During Electromagnetic Metal Forming, Second International Conference on High Speed Forming, 2006, pp. 23-32.

Carl Ross, and John T. Roth, The Effects of DC Current on the Tensile Properties of Metals, Proceedings of International Mechanical Engineering Congress and Exposition, 2005, Nov. 5-11, 2005, Orlando Florida, USA. IMECE2005-81072.

Timothy A Perkins and John T. Roth, The Reduction of Deformation Energy and Increase in Workability of Metals Through an Applied Electric Current, Proceedings of International Mechanical Engineering Congress and Exposition, 2005, Nov. 5-11, 2005, Orlando, Florida, USA. IMECE2005-18060.

* cited by examiner

METHOD AND APPARATUS FOR FORMING A BLANK AS A PORTION OF THE BLANK RECEIVES PULSES OF DIRECT CURRENT

BACKGROUND OF THE INVENTION

1. Field of the Invention

The present invention relates to a method and apparatus for forming a sheet metal blank a tubular blank or a partially formed blank while pulses of current are applied to the blank.

2. Background Art

The extent to which metal parts may be formed by plastically deforming sheet metal blanks or tubular blanks is limited by the strength and the inherent formability of the metal. Complex parts that have pronounced recesses or protrusions may not be formed from a single blank if the formability of the metal is exceeded by the strain required for forming the part. In some instances, parts with complex geometries may require forming multiple parts separately and joining them together by spot welding, riveting, or otherwise fastening the panels together. Forming multiple parts that must be assembled together to create a combined part of the desired shape increases the number of parts and the costs associated with manufacturing the combined part.

There is a need for a method and apparatus for forming extensively formed parts made in a single piece that are plastically deformable to the maximum extent.

SUMMARY OF THE INVENTION

A method of forming a sheet metal blank or tubular blank in a forming tool is provided in which pulsed DC current is delivered to the sheet metal blank to improve formability. As used herein the term "blank" should be construed to include sheet metal blanks, tubular blanks and partially formed parts made from such blanks. The metal forming tool may have an upper die and a lower die that are used to form the metal blank. Each die may have multiple parts depending upon the function of the die. The metal forming tool has first and second electrodes that are connected in an electrical circuit to a source of direct current. It should be understood that references to first and second electrodes do not limit the invention to two electrodes. Multiple electrodes could be attached to the upper and lower dies to control current flow through the blank. The electrodes are electrically insulated to minimize current flow through the metal forming tool. The method comprises loading the blank into the forming tool and closing the upper die and the lower die. The electrical circuit is completed from the first electrode to the second electrode through a portion of the blank. The electrical current is pulsed intermittently from the source of direct current through the portion of the blank in a plurality of pulses having a duration of, for example, between 0.1 and 5 seconds. The blank is formed while the electrical current is pulsed intermittently through the blank.

Other features of the method that may be incorporated include providing air flow to a portion of the blank during the pulsing step to prevent overheating of the blank which may lead to grain growth and aging. Alternatively, an equivalent cooling effect can be obtained by cooling with another gaseous or liquid cooling medium.

The duration of the pulses of current provided will vary depending upon the characteristics of the blank. For example, an aluminum blank may require pulses having a duration of between 1 and 2 seconds. The portion of the blank that receives the direct current pulses is generally in the vicinity of the portion of the blank that is subjected to the most extreme plastic deformation during the forming step.

Either or both of the lower die or upper die may be formed of a composite non-conductive material. As used herein, the term non-conductive should be interpreted to mean two or more orders of magnitude less conductive than the blank. The electrodes may be provided at spaced locations on the lower die, upper die, or on a binder or other die part that engages the blank. The binder applies pressure to the blank to clamp the blank against the lower die. The portion of the blank that is subject to the pulses of DC current is generally disposed between the first and second electrodes.

The upper die and the lower die may have a spray formed forming surface. In this case, the die surfaces may be electrically insulated from each other. For example, the first electrode may be provided on the lower die and the second electrode may be provided on the upper die. The binder of the upper die engages the blank and applies pressure to the blank to clamp the blank against the lower die. Alternatively, the second electrode may be disposed in the punch that is located inside the binder.

In another embodiment of the invention, a third electrode that is of the same polarity as the first electrode may be provided on the lower die. The step of completing the electrical circuit may further comprise completing an electrical circuit between the third electrode to the second electrode. The step of intermittently pulsing the electrical current may further comprise intermittently pulsing electrical current in a plurality of pulses through a second portion of the blank that is disposed between the second and third electrodes.

According to another aspect of the invention, the pulses may have a uniform duration. Alternatively, the pulses may be of varied duration and can be of a decreasing or an increasing period of duration. The current density of the pulses can be changed, as well as the time interval between pulses. Excellent results have been obtained with a combination of variable length of intervals, variable current density, and variable duration of the pulses.

The invention may also be characterized as a forming tool that is used to form a blank. The forming tool includes an upper die that has a binder and a punch, and a lower die that is secured in the press in an opposed relationship relative to the upper die. A first electrode may be assembled to a surface of the lower die that contacts the blank at a first location. A second electrode may be assembled to a surface of the upper die that contacts the blank at a second location. The portion of the blank that is to be plastically deformed is located generally between the first and second locations. An electrical circuit is connected to a source of direct current and to the first and second electrodes. The electrical circuit is controlled by a controller to provide a plurality of pulses of direct current to a selected portion of the blank. The plurality of pulses may each have a predetermined duration or may be of varied duration. The duration of the pulses can be varied by providing controlled increasing or decreasing pulse duration. Instead of controlling the duration of the pulses, the process can also be controlled or modified by providing constant or variable length intervals between pulses. Further, the magnitude of current density may be constant or variable. The upper die engages the lower die to form the blank during a forming stroke of the press while the controller provides pulses of the desired duration and density that are provided at selected intervals during the forming stroke of the press.

According to other features of the invention, an air flow directing apparatus may be provided that directs air towards the portion of the blank to be deformed during the forming stroke. The binder on the upper die may engage the blank and apply pressure to the blank to clamp the blank against the lower die. The second electrode may be disposed in the punch that is disposed within the binder. A third electrode may be provided that is of the same polarity as the first electrode on the lower die. As previously stated, more electrodes can be provided and the indicated polarity of the electrodes could, of course, be reversed. The electrical circuit may be completed between the first, second and third electrodes. In this way, the plurality of pulses of direct current may be provided through a second portion of the blank. In a similar manner, more electrodes can be used to pulse direct current through more portions of the blank.

Alternatively, the forming tool for forming a blank may be a media forming tool such as a hydroforming, a gas media forming, an elastomeric forming, or a conventional press forming tool. The tool may comprise a forming member and die as previously described to which first and second electrodes (or more) are assembled. The first electrode is assembled to a surface of the die that contacts the blank at a first location. The second electrode may also be assembled to a surface of the die that contacts the blank at a second location that is spaced from the first location. A portion of the blank that is to be plastically deformed is generally located between the first and second locations. An electrical circuit is connected to a source of direct current and to the first and second electrodes. The electrical circuit is controlled by a controller that provides a plurality of pulses of direct current to the blank for a predetermined duration. When the forming member engages the die to form the blank during a forming operation, the controller generally contemporaneously provides a plurality of pulses.

According to other features and aspects of the alternative embodiment, an air flow directing apparatus may be provided that directs air toward the portion of the metal blank to be formed during the pulsing step. The forming member may be a conventional ram or punch of a press or a media forming tool, for example, a hydroforming tool, a gas forming tool, or an elastomeric tool.

The die may be formed of a composite non-conductive material. Multiple electrodes may be provided at spaced locations on the die. A binder may apply pressure to the blank to clamp the blank against the lower die with a deeply drawn portion of the blank being disposed between the electrodes. The arrangement and number of electrodes may be varied to provide a greater concentration of electrical current in areas adjacent the maximum draw area while providing less current in this area.

The above features of the invention and others will be better understood in view of the attached drawings and the following detailed description of the illustrated embodiments.

DETAILED DESCRIPTION OF THE PREFERRED EMBODIMENT(S)

Figure 1:
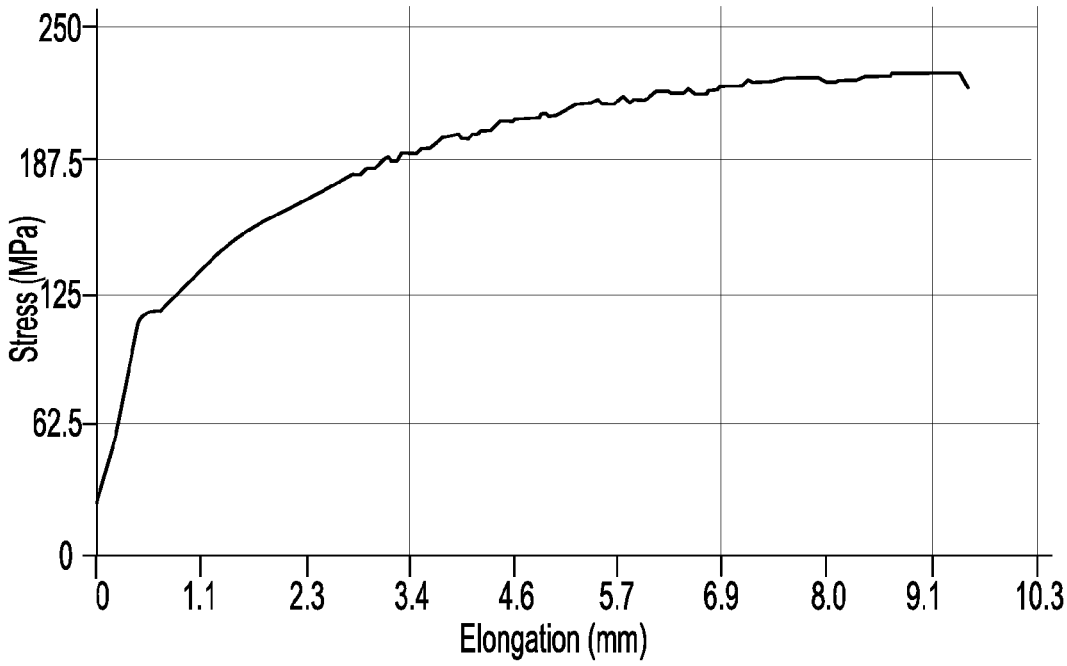
FIG. 1 is a stress/elongation diagram of AA5754 aluminum alloy.

Detailed embodiments of the present invention are disclosed that are intended to be understood as examples of the invention that may be embodied in various and alternative forms. The drawing figures are not necessarily to scale, some drawing figures may be exaggerated or minimized to show the details of the particular components. Therefore, specific structural and functional details disclosed herein are not to be interpreted as limiting, but merely as a representative basis for the claims and for teaching one skilled in the art to practice the present invention.

The present invention provides both a method and an apparatus for forming a panel from a metal sheet that has a forming strain limit that may be exceeded at a location in the panel when formed by a conventional forming operation. The forming capability of the sheet may be enhanced by using pulsed direct current during the forming operation. The following study performed by the Applicants illustrates at least one embodiment of the present invention.

The materials used in this study are shown in Tables 1 and 2 with their respective mechanical properties and chemical composition.

TABLE 1

| Alloy | Manufacturer | Y.S. (MPa) | U.T.S. (MPa) |
|---|---|---|---|
| 6016-T4 | Alcan | 116 | 320 |
| 6111-T4 | Alcan | 145 | 284 |
| 5754-0 | Alcoa | 115 | 220 |

TABLE 2

| | 6016-T4 | 6111-T4 | 5754-0 |
|---|---|---|---|
| Mg | 0.61 | 0.89 | 2.6-3.6 |
| Si | 0.97 | 0.54 | <0.40 |
| Cu | 0.04 | 0.67 | <0.10 |
| Fe | — | 0.19 | <0.40 |
| Mn | 0.04 | 0.22 | <0.50 |
| Al | Bal. | Bal. | Bal. |

Referring to FIG. 1, a stress/elongation diagram is provided of AA5754 aluminum alloy. The diagram was generated from a test specimen of the aluminum alloy, which was subject to an applied tensile force. The resulting overall elongation of the aluminum alloy is illustrated in the diagram as being just less than 9.5 mm of cross-head displacement.

Figure 2:
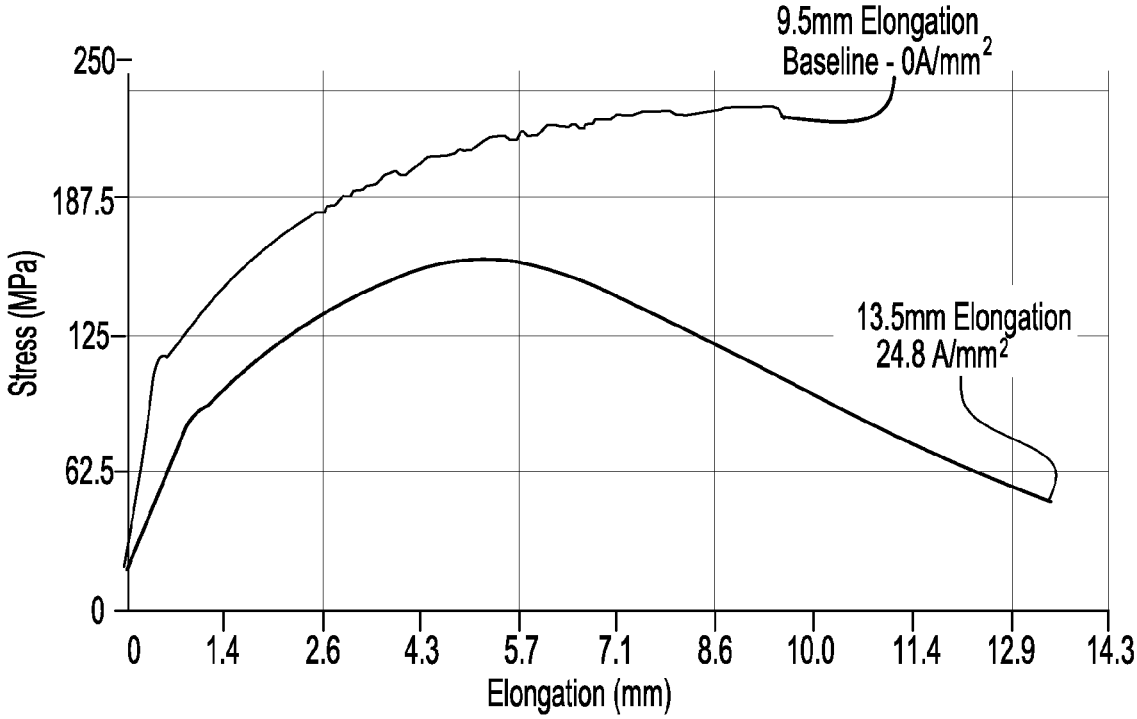
FIG. 2 is a stress/elongation diagram of AA5754 aluminum alloy with a continuous direct current applied to the test specimen that is shown with the baseline diagram of FIG. 1 for comparison.

Referring to FIG. 2, a stress/elongation diagram is provided of AA5754 aluminum alloy with a continuous direct current (DC current) applied to the test specimen concurrent with an applied tensile force. The baseline of FIG. 1 is also shown for comparison. Although the DC treatment did not substantially increase the overall elongation of the specimen, a significantly larger local deformation was observed in the "necking area" of the specimen. This is illustrated in the diagram by the continual drop in stress as the elongation increases beyond about 6 mm of cross-head displacement. This suggests that superimposing a continuous DC current on a metal specimen enhances local deformation in response to an applied force.

Figure 3:
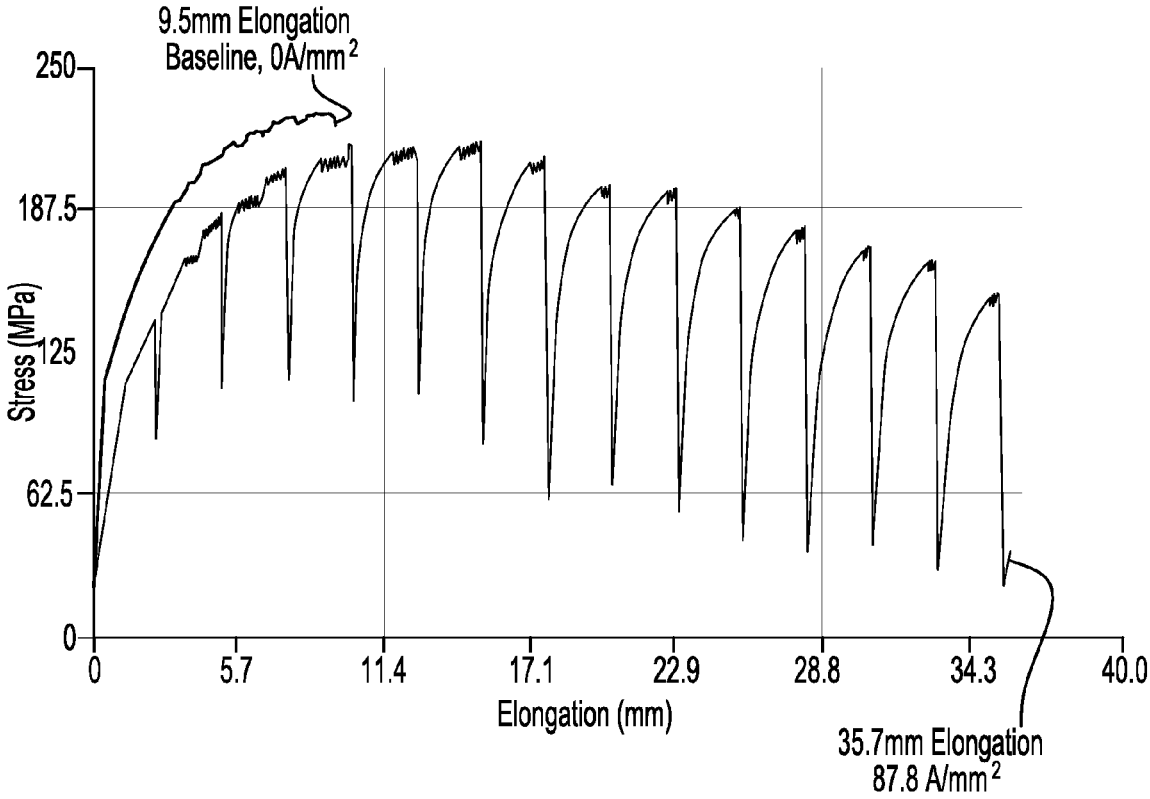
FIG. 3 is a stress/elongation diagram of AA5754 aluminum alloy with pulsed direct current applied to the test specimen that is shown with the baseline diagram of FIG. 1 for comparison.

Referring to FIG. 3, a stress/elongation diagram is provided of AA5754 aluminum alloy with pulsed DC current applied to the test specimen concurrent with a tensile force. The test specimen was pulsed 13 times with each pulse having a duration of about one second. As illustrated, there is a significant drop in the stress at the moment the DC current is applied. This is followed by a quick recovery of the stress with a high work-hardening modulus when the DC current is discontinued. The significantly increased work hardening modulus may account for the higher elongation, which was above 35 mm of cross-head displacement. The baseline of FIG. 1 is also shown for comparison.

Figure 4:
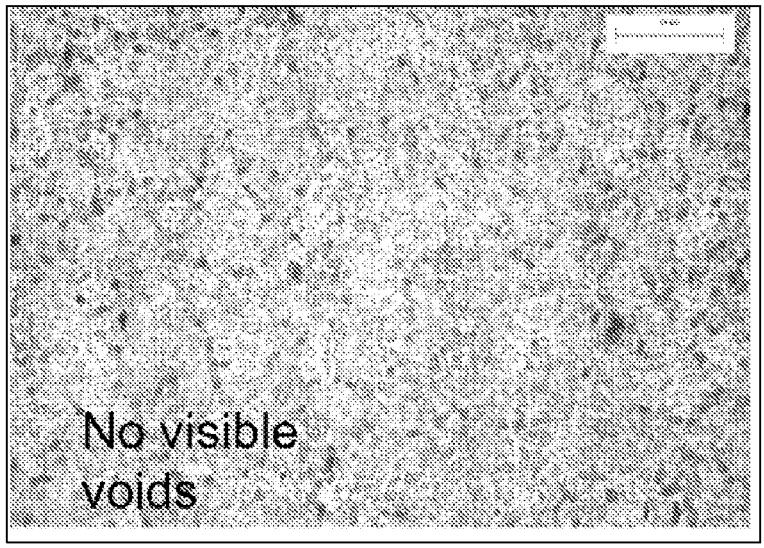
FIG. 4 is a photo of the grain microstructure of a test specimen used in FIG. 1.
Figure 5:
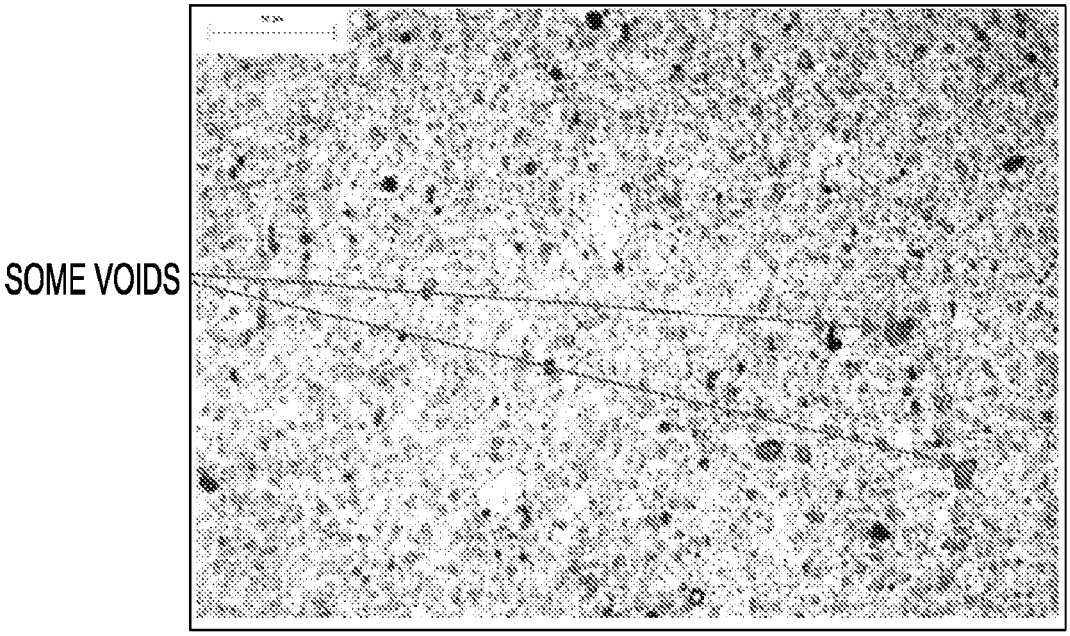
FIG. 5 is a photo of the grain microstructure of a test specimen used in FIG. 2.
Figure 6:
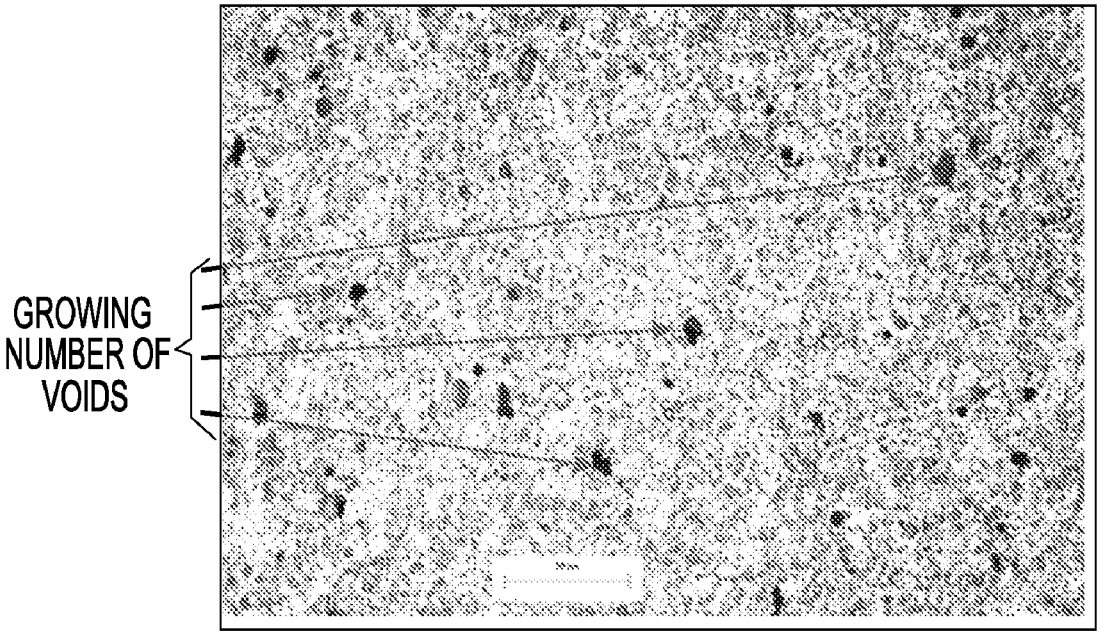
FIG. 6 is a photo of the grain microstructure of a test specimen used in FIG. 3.

Referring to FIGS. 4-6, photos of the grain microstructure of the test specimens used respectively in FIGS. 1-3 are provided. In FIG. 4, almost no voids are observed in the grain microstructure. In FIG. 5, there are a number of relatively larger voids in the grain microstructure. In FIG. 6, there is an increase in the void density over FIGS. 4 and 5. However, the void density and the size of the voids illustrated in FIG. 6 are still relatively lower when compared to other processes, such as for example, super plastic forming.

Applicants also noted that grain growth of the grain microstructure, which is typically observed after heat treatment, annealing or super plastic deformation of 5xxx alloys, was not present after pulsed DC treatments. The relatively small size and low density of the voids in combination with minimal or no grain growth may result in improved formability of the metal. Comparing FIGS. 1-3, continuous DC treatments did not substantially improve the elongation of AA5754 aluminum alloy. However, pulsating DC treatments more than tripled the overall elongation.

A similar study was conducted on AA6111-T4 and AA6016-T4 aluminum alloys. Additionally, air flow was applied to some of the test specimens during treatment because some 6xxx aluminum alloys have a propensity to age when exposed to higher temperatures. The air flow may help to minimize the temperature increase during DC treatments and thus, minimize aging effects for certain alloys.

Figure 7:
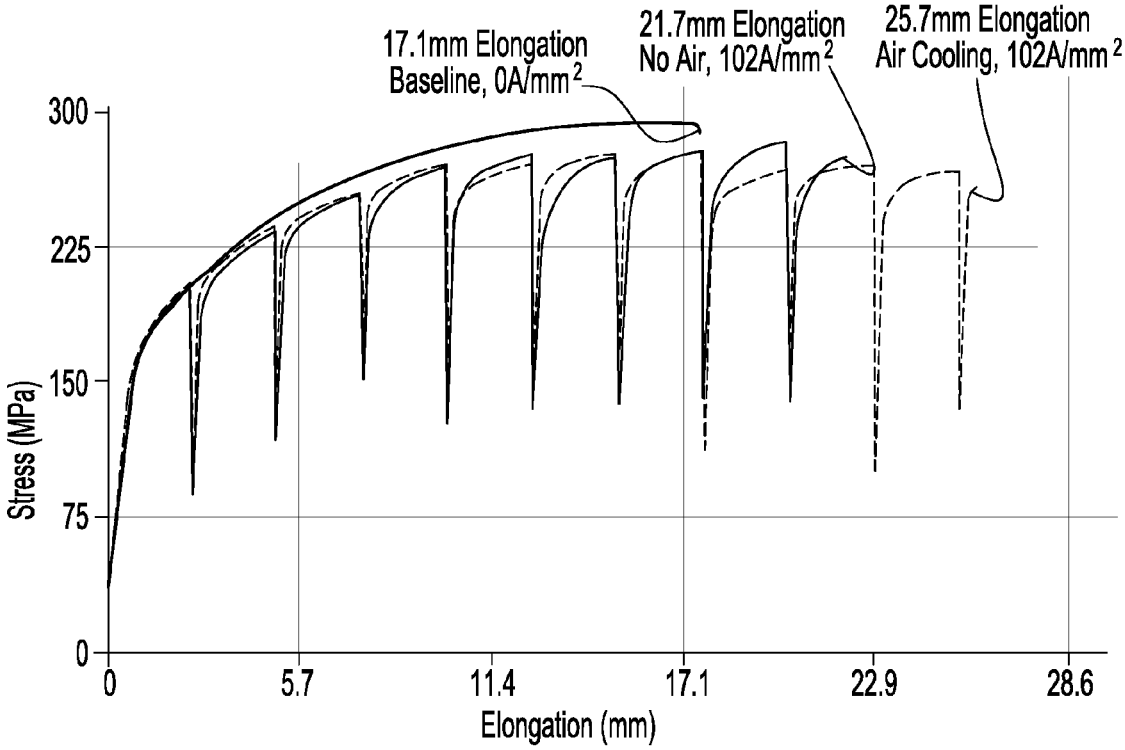
FIG. 7 is a stress/elongation diagram comparing the tensile properties of AA6111-T4 aluminum alloy with and without pulsed direct current and with and without air cooling.

Referring to FIG. 7, a stress/elongation diagram is provided comparing the tensile properties of AA6111-T4 aluminum alloy with and without pulsed DC treatments, and with and without air flow during these treatments. The baseline test specimen, which was neither exposed to DC current nor air flow, had an overall elongation of 17.1 mm of cross-head displacement. The test specimen, which was exposed to 102 A/mm$^2$ of pulsed DC current, had an overall elongation of approximately 21.7 mm of cross-head displacement. A further improvement in the overall elongation to about 25.7 mm of cross-head displacement was observed when the test specimen was exposed to both 102 A/mm$^2$ of pulsed DC current and air flow. The original current density was 1250 amps/12.7 mm$^2$≈100 amps/mm$^2$ and was increased to approximately 160 amp/mm$^2$ by the end of the test.

Figure 8:
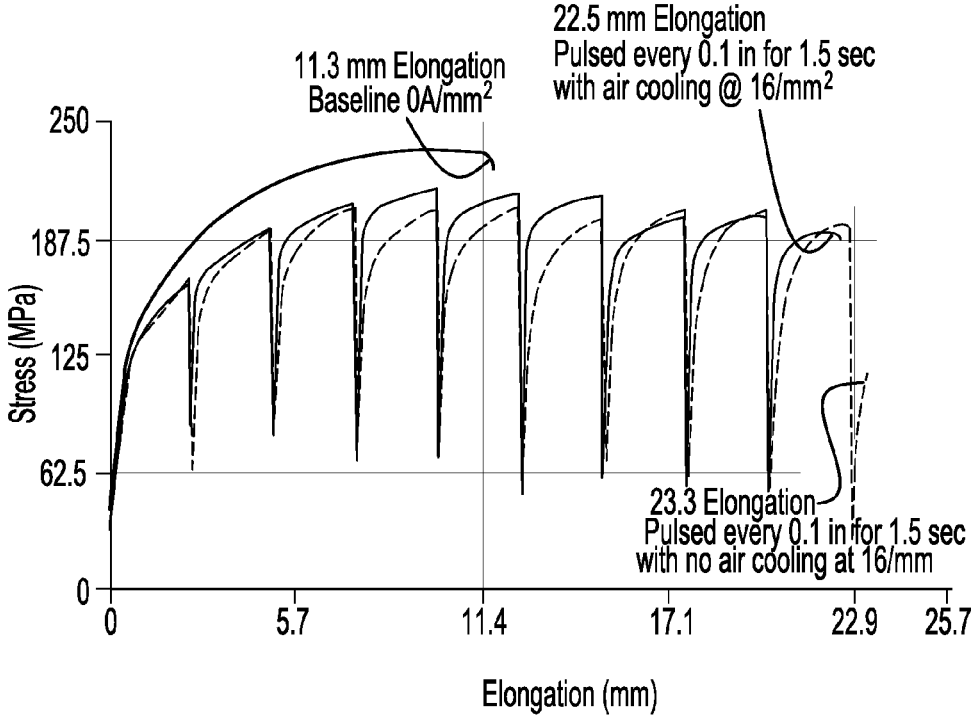
FIG. 8 is a stress/elongation diagram comparing the tensile properties of AA6016-T4 aluminum alloy with and without pulsed direct current.

Referring to FIG. 8, a stress/elongation diagram is provided comparing tensile properties of AA6016-T4 aluminum alloy with and without pulse DC treatments, and with and without air flow during these treatments. The baseline test specimen, which was neither exposed to DC current nor air flow, had an overall elongation of 11.3 mm of cross-head displacement. The test specimen, which was exposed to pulsed DC treatments, had an overall elongation of greater than 23.3 mm of cross-head displacement. Air flow, however, did not provide an additional improvement in overall elongation for AA6016 aluminum alloy with pulsed DC treatments.

Figure 9:
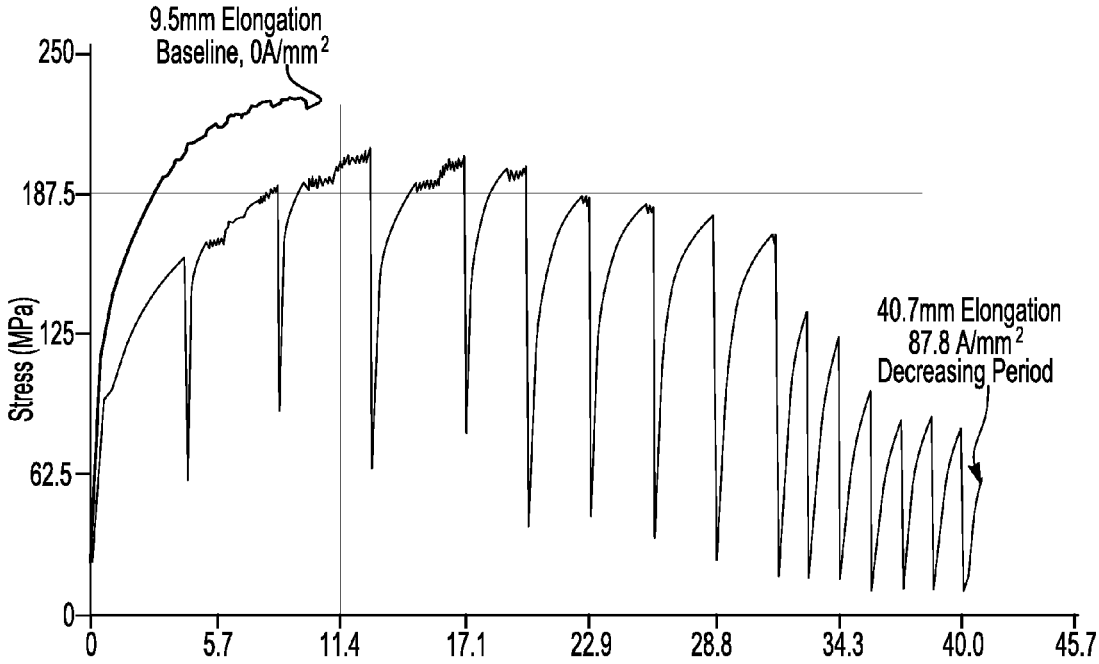
FIG. 9 is a stress/elongation diagram comparing the tensile properties of AA5754 aluminum alloy with pulsed direct current of decreasing period that is shown with the baseline diagram of FIG. 1.

Referring to FIG. 9, a stress/elongation diagram is provided comparing tensile properties of AA5754 aluminum alloy with and with decreasing period pulse DC treatments. The baseline test specimen was not exposed to DC current and had an overall elongation of 9.5 mm of cross-head displacement. The test specimen, as shown in FIG. 9, was exposed to decreasing period pulsed DC treatments. The test specimen was exposed to 87.8 A/mm$^2$ of pulsed DC current. The controller was used to reduce the period of the DC pulses during the course of the tensile test. The test specimen had an overall elongation of 40.7 mm of cross-head displacement, an improvement of around 4.3 times.

Figure 10:
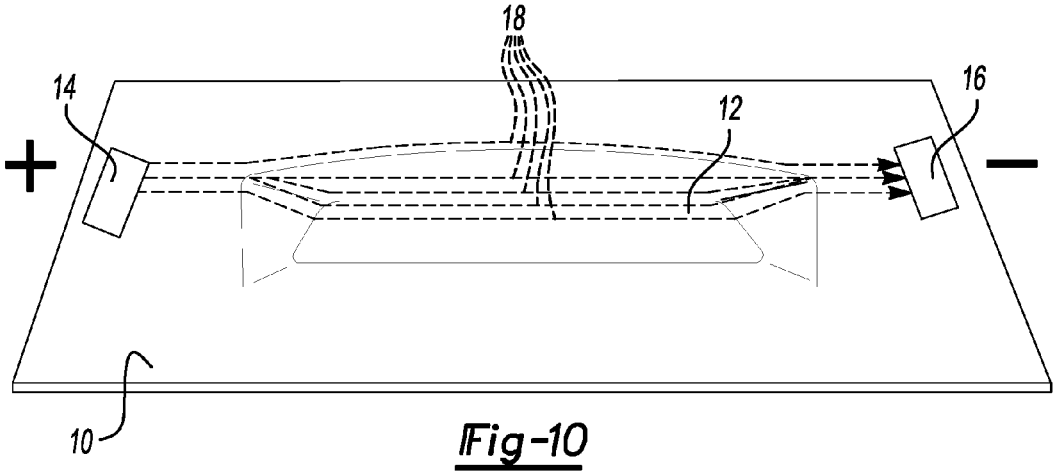
FIG. 10 is a perspective view of a metal panel with a formed deep draw portion.

Referring to FIG. 10, a perspective view is provided of an embodiment of a metal panel 10 with a deep draw portion 12 that is formed from a sheet metal blank, as shown. The sheet metal blank could also be a tubular blank. The deep draw portion 12 may have a shape which is beyond the forming limit of the metal. For example, during forming of the metal panel 10, the deep draw portion 12 may be subjected to substantial plastic deformation, which may exceed the maximum strain of the forming limit diagram for the corresponding line strain path trajectory.

During the forming process, a first electrode contacts the metal panel 10 at area 14 and a second electrode contacts the panel at area 16. Areas 14 and 16 may be arranged such that an electrical current 18 flows between the two areas across or in the vicinity of the deep draw portion 12.

Figure 11:
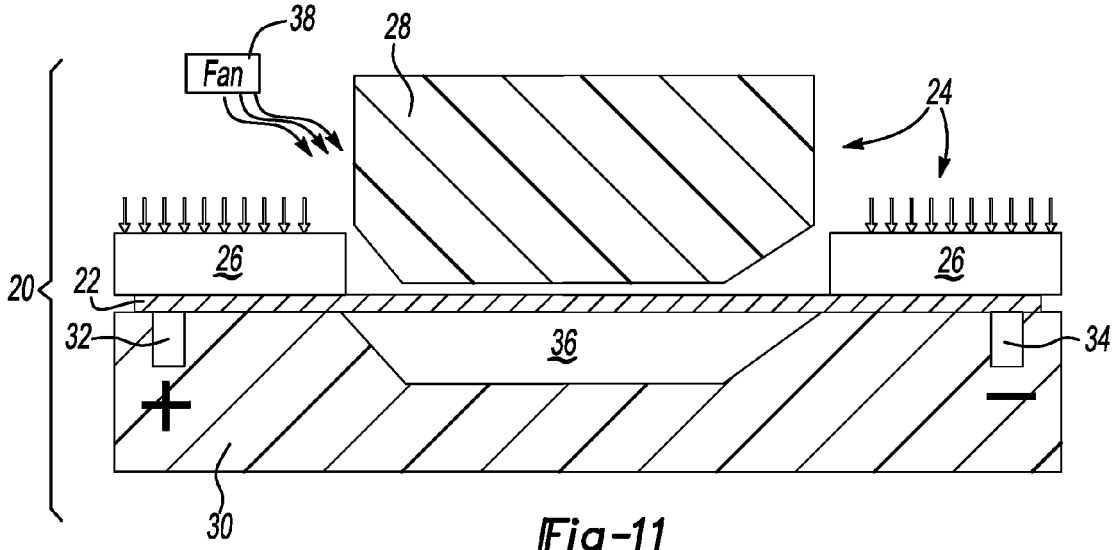
FIG. 11 is a sectional view of a forming tool made in accordance with an embodiment of the present invention.

Referring to FIG. 11, a sectional view is provided of a forming tool 20 in accordance with an embodiment of the present invention. The forming tool 20 may be operated by a press to plastically deform a blank 22. The forming tool 20 may be part of a metal stamping operation, as shown, or a hydroforming operation.

The forming tool 20 may comprise an upper die 24, that is secured within the press. The upper die 24 may have a binder 26 and a punch 28 or may otherwise be constructed as a forming die. The binder 26, for example, may include mechanical springs or gas springs used to clamp the blank 22. Other suitable forming die configurations known to those skilled in the art may also be used for binders 26.

The punch 28 is secured within the press in an opposing relationship to a lower die 30. The punch 28, which is typically secured to a ram of the press, provides a stroking movement via the ram, which forces the blank 22 into the lower die 30. The lower die 30 is matched with the upper die 24 for forming the blank 22. The upper die 24 and punch 28 illustrated in FIG. 11 may also be construed to be a media forming tool, such as a hydroforming tool, a gas forming tool, or an elastomeric forming tool.

In at least one embodiment, the lower die 30 is formed of a composite non-conductive material. In at least one other embodiment, the lower die 30 has a spray formed layer over the composite non-conductive material. Although the spray form layer may be conductive, it will typically have an electrical resistance several times greater than the blank 22. The spray formed layer is applied to the composite non-conductive material as a liquid metal which solidifies. The spray formed layer may provide a robust forming surface. Moreover, the terms non-conductive and insulated are understood to be relative terms meaning at least two orders of magnitude greater in electrical resistance when compared to the blank 22.

A first electrode 32 is assembled to a surface of the lower die 30 and contacts the blank 22 at a first location. A second electrode 34 is assembled to a surface of the lower die 30 and contacts the blank 22 at a second location that is spaced from the first location. The electrodes 32 and 34 are electrically insulated from the forming tool 20. A portion of the blank 22, which may be plastically deformed into a deep draw cavity portion 36 of the lower die 30, is located between the first electrode 32 and the second electrode 34.

The first and second electrodes 32 and 34 are connected to a DC source to form an electrical circuit. A controller is used to operate the electrical circuit and provide a plurality of pulses of DC current to the portion of the blank which is to be plastically deformed. The controller may be a computer or other logical device, which executes an application program. The plurality of DC pulses may each have a predetermined duration, interval, and magnitude. Alternatively, beneficial results may also be obtained with pulses that may have variable duration, at variable intervals, and with variable current density.

The upper die 24 engages the lower die 30 to form the blank 22 during a forming stroke of the punch 28 via the ram of the press. The controller provides the plurality of DC pulses during at least the forming stroke. In at least one embodiment, the duration of the DC pulses may be between 0.1 and 5 seconds. In at least one other embodiment, the DC pulses are between 1 and 2 seconds, or about 1.5 seconds.

The forming tool 20 may further provide air flow directed towards the portion of the blank 22 during the forming stroke. Air flow may be provided by a fan 38, blower, vacuum arrangement or any other suitable air flow inducing apparatus. The volume of airflow is preferably controlled to prevent localized over-heating of the blank.

In at least one embodiment, a method for forming a blank 22 from the forming tool 20 comprises loading the blank 22 into the forming tool 20. The upper die 24 and the lower die 30 are closed. An electrical circuit is completed between the first electrode 32 and the second electrode 34 through a portion of the blank 22. Electrical current is pulsed intermittently through the portion of the blank 22 in a plurality of DC pulses, each having a predetermined duration. The blank 22 is formed during the intermittent propagation of electrical current. Alternatively, the current may be pulsed with pulses of variable duration and at variable intervals.

Figure 12:
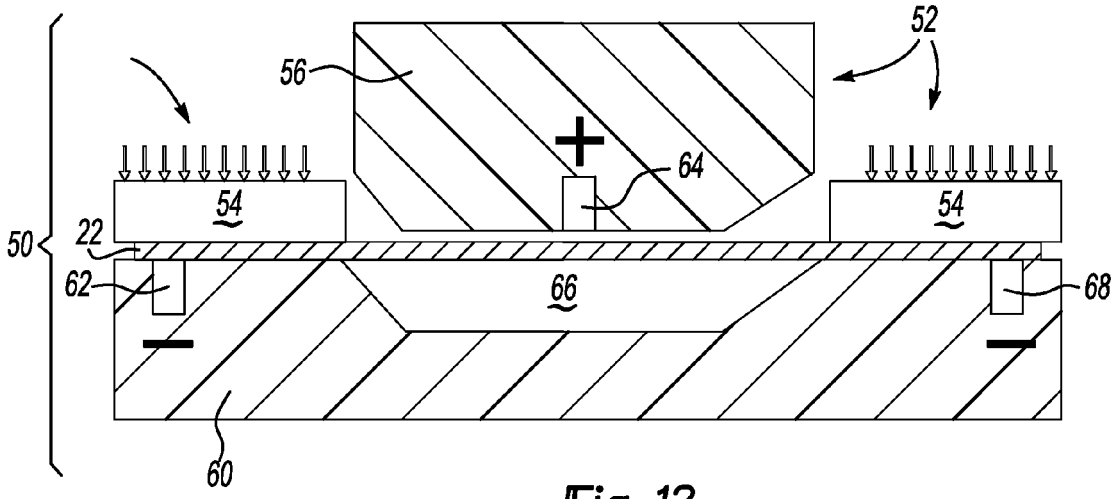
FIG. 12 is a sectional view of a forming tool made in accordance with another embodiment of the present invention.

Referring to FIG. 12, a sectional view is provided of a forming tool 50 for forming a blank 22 in accordance with another embodiment of the present invention. The forming tool 50 comprises an upper die 52 secured within the press. The upper die 52 has a binder 54 and a punch 56.

A lower die 60 is secured within the press in an opposing relationship with the upper die 52. In at least one embodiment, both the upper and lower dies 52 and 60 are formed of a composite non-conductive material. In at least one other embodiment, the upper and lower dies 52 and 60 may further include a spray formed outer layer.

A first electrode 62 is assembled to a surface of the lower die 60 such that it contacts the blank 22 at a first location. A second electrode 64 is assembled to a surface of the upper die 52 such that it contacts the blank 22 at a second location. The electrodes 62 and 64 are electrically insulated from the forming tool 50. A portion of the blank 22, which may be plastically deformed by the punch 56 into a deep draw cavity portion 66 of the lower die 60, may be located between the locations.

In at least one embodiment, the second electrode 64 is disposed in the punch 56. The punch 56 may be disposed within the binder 54. The second electrode 64 directly contacts the blank 22 during forming. The binder 54 may engage the blank 22 to clamp the blank 22 against the lower die 60.

The first and second electrodes 62 and 64 are connected to a DC source to form an electric circuit with the blank 22. While electrode 62 is indicated to be "–" and electrode 64 is indicated to be "+" these designations are arbitrary and could be reversed. A controller for operating the electrical circuit provides a plurality of DC pulses to the portion of a blank 22 which may be plastically deformed. The plurality of DC pulses may each have a predetermined duration or a variable duration. The upper die 52 engages the lower die 60 to form the blank 22 during a forming stroke of the press. The controller provides a plurality of pulses at least during the forming stroke of the press. In at least one embodiment, the forming tool 50 may further comprise an apparatus for directing air flow towards the portion of the blank 22 during the forming stroke. The airflow is provided to prevent overheating the blank.

The forming tool 50 may further include a third electrode 68 provided on the lower die 60. The third electrode is electrically insulated from the forming tool 50. The third electrode 68 forms an electrical circuit with the second electrode 64. The illustrated polarity designations could be reversed and more electrodes may be provided. A plurality of DC pulses may be provided to a second portion of the blank 22 that is disposed between the second and third electrodes 64 and 68, and is plastically deformed into the deep draw cavity portion 66.

In at least one embodiment, the third electrode 68 is the same polarity as the first electrode 62. The binder 54 applies pressure to the blank 22 to clamp the blank against the lower die 60 while the pulses of DC current are provided to the blank as it is formed.

While embodiments of the invention have been illustrated and described, it is not intended that these embodiments illustrate and describe all the possible forms of the invention. The words used in a specification are words of description rather than limitation, and it should be understood that various changes may be made without departing from the spirit and scope of the invention.

What is claimed:

1. A method of forming a metal blank in a forming tool, the forming tool having an upper die and a lower die that are moved by a press to form the blank, a plurality of electrodes are provided on the forming tool, the electrodes are connected in an electrical circuit to a source of direct current and are electrically insulated from the metal forming tool, the method comprising:

loading the blank into the metal forming tool;

closing the upper die and the lower die;

completing the electrical circuit between at least two spaced electrodes through at least one portion of the blank;

pulsing electrical current through said at least one portion of the blank from the source of direct current in a plurality of pulses having a duration of between 0.1 and 5 seconds; and forming the blank along said at least one portion during the pulsing step.

2. The method of claim 1 further comprising directing air to flow toward the portion of the blank during the pulsing step.

3. The method of claim 1 wherein the pulses have a duration of between 1 and 2 seconds.

4. The method of claim 1 wherein the portion of the blank is disposed in a location that is subjected to substantial plastic deformation during the forming step.

5. The method of claim 1 wherein the lower die is formed of a composite non-conductive material, and locating the plurality of electrodes comprising positioning a first electrode, a second electrode at spaced locations on the lower die, and engaging a binder that applies pressure to the blank to clamp the blank against the lower die, wherein the portion of the blank is disposed between the first and second electrodes.

6. The method of claim 1, wherein the plurality of electrodes include a first electrode that is provided on the lower die and a second electrode that is provided on the upper die, engaging a binder against the blank and applying pressure to the blank to clamp the blank, wherein the second electrode is disposed in a punch, and wherein the portion of the blank is disposed between the first and second electrodes.

7. The method of claim 6, wherein the plurality of electrodes further include a third electrode that is of the same polarity as the first electrode, and wherein the step of completing the electrical circuit further comprises completing the electrical circuit from the third electrode to the second electrode and the step of pulsing the electrical current further comprises pulsing electrical current in the plurality of pulses through a second portion of the blank that is disposed between the second and third electrodes.

8. The method of claim 1 wherein the pulses have a uniform duration.

9. The method of claim 1 wherein the pulses have a varied duration.

10. The method of claim 9 wherein the pulses have a decreasing period of duration.

11. A forming tool for forming a blank that is operated by a press, the forming tool comprising:

an upper die secured to the press, the upper die having a binder and a punch;

a lower die secured to the press in an opposing relationship to the upper die;

a first electrode assembled to a surface of the lower die that contacts the blank at a first location;

a second electrode assembled to a surface of the upper die that contacts the blank at a second location that is spaced from the first location, and wherein a portion of the blank that is to be plastically deformed is located between the first and second locations;

an electrical circuit connecting a source of direct current to the first and second electrodes;

a controller operating the electrical circuit to provide a plurality of pulses of direct current having a controlled duration, a controlled magnitude, and at controlled intervals to the portion of the blank;

wherein the upper die engages the lower die to form the blank during a forming stroke of the press, and wherein the controller provides the plurality of pulses at least during the forming stroke of the press.

12. The forming tool of claim 11 further comprising an air flow directing apparatus that directs air toward the portion of the blank during the forming stroke.

13. The forming tool of claim 11 wherein the pulses have a uniform duration of between 0.1 and 5 seconds.

14. The forming tool of claim 11 wherein the binder of the upper die engages the blank and applies pressure to the blank to clamp the blank against the lower die, wherein the second electrode is disposed in a punch that is disposed within the binder.

15. The forming tool of claim 11 wherein a third electrode that is of the same polarity as the first electrode is provided on the lower die, and wherein the electrical circuit is completed between the third electrode to the second electrode and the plurality of pulses of direct current are provided through a second portion of the blank that is disposed between the second and third electrodes.

16. A forming tool for forming a blank comprising:

a forming member;

a die secured in an opposing relationship to the forming member;

a first electrode assembled to a surface of the die that contacts the blank at a first location;

a second electrode assembled to a surface of the die that contacts the blank at a second location that is spaced from the first location, and wherein a portion of the blank that is to be plastically deformed is located between the first and second locations;

an electrical circuit connecting a source of direct current to the first and second electrodes;

a controller for operating the electrical circuit to provide a plurality of pulses of direct current controlled magnitude to the portion of the blank, wherein the plurality of pulses each have a controlled duration and at controlled intervals; and wherein the forming member engages the die to form the blank during a forming operation, and wherein the controller provides the plurality of pulses at least during the forming operation.

17. The forming tool of claim 16 further comprising an air flow directing apparatus that directs air toward the portion of the blank during the forming stroke.

18. The forming tool of claim 16 wherein the forming member is a media forming tool.

19. The forming tool of claim 16 wherein the pulses are controlled by the controller to have a duration that is varied.

20. The forming tool of claim 16 wherein the first and second electrodes are provided at spaced locations on the lower die that are engaged by a binder with the binder applying pressure to the blank to clamp the blank against the lower die with the portion of the blank being disposed between the first and second electrodes.

* * * * *